US009410273B2

(12) United States Patent
Miyauchi et al.

(10) Patent No.: US 9,410,273 B2
(45) Date of Patent: Aug. 9, 2016

(54) FIBER BUNDLE AND WEB

(75) Inventors: Minoru Miyauchi, Osaka (JP); Yukiharu Simotsu, Osaka (JP); Akinori Maekawa, Osaka (JP)

(73) Assignees: ES FIBERVISIONS CO., Osaka (JP); ES FIBERVISIONS HONG KONG LIMITED, Kowloon (HK); ES FIBERVISIONS APS, Varde (DK); ES FIBERVISIONS LP GA (US)

( * ) Notice: Subject to any disclaimer, the term of this patent is extended or adjusted under 35 U.S.C. 154(b) by 2086 days.

(21) Appl. No.: 12/307,793

(22) PCT Filed: Aug. 10, 2007

(86) PCT No.: PCT/JP2007/065976

§ 371 (c)(1),
(2), (4) Date: Jan. 7, 2009

(87) PCT Pub. No.: WO2008/018635

PCT Pub. Date: Feb. 14, 2008

(65) Prior Publication Data

US 2009/0208699 A1 Aug. 20, 2009

(30) Foreign Application Priority Data

Aug. 11, 2006 (JP) ..... 2006-220109
Jun. 28, 2007 (JP) ..... 2007-170684

(51) Int. Cl.
*B32B 5/12* (2006.01)
*D04H 13/00* (2006.01)
(Continued)

(52) U.S. Cl.
CPC ..... *D04H 13/002* (2013.01); *D01F 8/06* (2013.01); *D01F 8/14* (2013.01); *D04H 1/42* (2013.01); *Y10T 428/24132* (2015.01); *Y10T 428/2924* (2015.01)

(58) Field of Classification Search
CPC ..... B32B 5/12
USPC ..... 428/114, 370
See application file for complete search history.

(56) References Cited

U.S. PATENT DOCUMENTS 3,501,811 A 3/1970 Watson
3,737,950 A 6/1973 Bolliand et al.
(Continued)

FOREIGN PATENT DOCUMENTS

EP 1184496 3/2002
GB 1159601 7/1969
(Continued)

OTHER PUBLICATIONS

Machine Translation for JP 09-273037 (15 pages total).*
(Continued)

*Primary Examiner* — Peter Y Choi
(74) *Attorney, Agent, or Firm* — Hamre, Schumann, Mueller & Larson, P.C.

(57) ABSTRACT

There is provided a fiber bundle that strikes an excellent balance between the properties and performance of the resulting web and the finished products obtained from this web, and cost, ease of work, and productivity. There is also provided a method for manufacturing a web using this fiber bundle. There is also provided a web that is uniform and has excellent soft touch and bulkiness. This is achieved by a fiber bundle with a total denier of 10,000 to 500,000 dtex, obtained by bundling thermoplastic, conjugate, continuous fibers that have a single filament denier of 0.5 to 100 dtex/f and in which the center of gravity of conjugate components varies among the conjugate components in a fiber cross section, wherein the thermoplastic, conjugate, continuous fibers that make up the fiber bundle have a spontaneous crimp of 8 to 30 crimps per 2.54 cm, the fiber bundle density as defined by D1/(W1×L1) (where D1 is the total denier, W1 is the fiber bundle width, and L1 is the fiber bundle thickness) is 100 to 2000 dtex/mm$^2$, and the density ratio by spreading (the web density/fiber bundle density after spreading by drawing to a ratio of 1.6 in a pinch roller spreading machine at a rate of 25 m/min and a fiber bundle temperature of 25° C.) is 0.10 or less.

4 Claims, 1 Drawing Sheet

(51) Int. Cl.

| | |
|---|---|
| ***D01F 8/06*** | (2006.01) |
| ***D01F 8/14*** | (2006.01) |
| ***D04H 1/42*** | (2012.01) |

(56) References Cited

U.S. PATENT DOCUMENTS

| | | | | |
|---|---|---|---|---|
| 4,332,762 | A | 6/1982 | Lynch | |
| 5,840,633 | A | 11/1998 | Kurihara et al. | |
| 6,048,808 | A | 4/2000 | Kurihara et al. | |
| 6,518,208 | B2 * | 2/2003 | Terakawa | 442/327 |
| 2003/0135182 | A1 | 7/2003 | Woon et al. | |
| 2004/0234757 | A1 * | 11/2004 | Goda | 428/357 |

FOREIGN PATENT DOCUMENTS

| | | | |
|---|---|---|---|
| JP | 44-4869 | | 2/1965 |
| JP | 9-273037 | A | 10/1997 |
| JP | 10-88454 | | 4/1998 |
| JP | 2002-69781 | A | 3/2002 |
| JP | 2005-200795 | A | 7/2005 |
| JP | 2006-124903 | | 5/2006 |
| RU | 2221529 | | 1/2004 |
| WO | 96/17121 | | 6/1996 |
| WO | 99/56687 | | 11/1999 |
| WO | 00/68476 | | 11/2000 |

OTHER PUBLICATIONS

Webpage for Fiber Innovation Technology: bicomponent fibers available at www.fitfibers.com/bicomponent_fibers.htm.*

Decision on Grant issued May 31, 2010 in the corresponding Russian patent application, and English language translation thereof.

Supplementary European Search Report issued in corresponding European Patent Application No. 07792606 dated May 6, 2010 (8 pages).

International Search Report of PCT/JP2007/065976, dated Nov. 20, 2007.

Written Opinion of the International Searching Authority of PCT/JP2007/065976, dated Nov. 20, 2007.

* cited by examiner

FIBER BUNDLE AND WEB

TECHNICAL FIELD

The present invention relates to a fiber bundle having good bundling and spreading properties, and to a web obtained by spreading this fiber bundle and characterized by bulkiness and softness. More particularly, the present invention relates to a fiber bundle characterized in that the thermoplastic, conjugate, continuous fibers that make up the fiber bundle are bundled in a state of high fiber density in packaging, physical distribution, and pull-up steps, but then exhibit spiral crimping when the fiber bundle is drawn in an spreading step, and the force of the manifestation of this spiral crimping opens the individual fibers. The present invention further relates to a web characterized by bulkiness and obtained by spreading this fiber bundle, and to a finished product obtained using this web.

BACKGROUND ART

Thermoplastic, conjugate fibers of PE/PP, PE/PET, PP/PET, and the like have been used for the surface layer in sanitary napkins and other such absorbent products, and in cleaning mops, the wiping components of wipers, and so forth. These thermoplastic, conjugate, continuous fibers are sometimes used in the form of a web obtained by spreading a continuous fiber bundle.

In a continuous fiber bundle, thermoplastic, conjugate, continuous fibers that have been crimped are bundled so as to stick together, and are in a state of high fiber density. When such a bundle is processed into the surface layer of sanitary napkins, the wiping components of wipers, and so forth, the manufacture of these products includes a step in which the thermoplastic, conjugate, continuous fibers that make up the fiber bundle are separated from one another in the width direction to increase the apparent width, which is known as an spreading step. The result of this spreading step is that the thermoplastic, conjugate, continuous fibers that were bundled together into a fiber bundle in a state of high fiber density are loosened from one another to obtain a web in a state of low fiber density. The surface layer of sanitary napkins, the wiping components of wipers, and so forth are manufactured from a web obtained in this way and having bulk and fiber density that are substantially uniform in the width direction.

Various methods have been employed to open a fiber bundle and obtain a uniform web. For example, Japanese Patent Application Publication (hereunder referred to as "JP KOKAI") No. Hei 9-273037 discloses that a tow (fiber bundle) having an apparently existent crimp and/or latent crimp, a single filament size of 0.5 to 100 denier, a total denier of 10,000 to 300,000, and an apparently existent crimp of 10 to 50 crimps per 25 mm has a width that is within a favorable range during drawing and spreading, and can be spread uniformly at high speed. Nevertheless, there is a need for a fiber bundle that will yield a high-bulk web more efficiently, and for this high-bulk web.

JP KOKAI No. 2002-69781 discloses a method for spreading a tow (fiber bundle) by imparting tension to the tow between rolls with a speed differential, and then elastically contracting, and imparting elongation and contraction to the crimp, wherein a sliding plate is brought into contact with the tow between the rolls to shift the fibers in the feed direction and make them spread better. Nevertheless, this requires the installation of a sliding plate in the equipment, and bringing the tow and the sliding plate into contact complicates the work, and both of these lead to considerable increases in cost.

Thus, attempts at spreading a fiber bundle and obtaining a uniform web at high productivity have been made from the standpoints of both improving the fiber bundle (the material) and improving the spreading method. However, if we consider cost, ease of work, productivity, and the properties and performance of the resulting web and the finished products obtained from this web, a satisfactory method has yet to be found.

DISCLOSURE OF THE INVENTION

It is an object of the present invention to provide a fiber bundle that strikes a good balance between the properties and performance of the resulting web and the finished products obtained from this web, and cost, ease of work, and productivity. More specifically, it is an object of the present invention to provide a fiber bundle that is bundled in a state of high fiber density in packaging, physical distribution, and pull-up steps, but has a latent crimp, and exhibits spiral crimping in an spreading step, providing a high-bulk web with excellent soft touch. It is another object of the present invention to provide a method for manufacturing a web, in which this fiber bundle is used. It is another object of the present invention to provide a web that is uniform and has high bulk and excellent soft touch. It is another object of the present invention to provide a member and finished product obtained using this web.

As a result of diligent research aimed at solving the above problems, the inventors discovered that if specific single filament denier, total denier, apparently existent crimp number, fiber bundle density, and the density ratio by spreading are satisfied in a bundle of thermoplastic, conjugate, continuous fibers in which the center of gravity of the conjugate components varies among the conjugate components in a fiber cross section, it is possible to obtain a web that is uniform and has high bulk and excellent soft touch from this fiber bundle via an spreading step. More specifically, the inventors perfected the present invention upon discovering that since the fiber bundle is bundled in a state of high fiber density prior to being spread, it can be packed well and is easier to handle, and when it is then subjected to a suitable drawing treatment in an spreading step, the latent crimp of the thermoplastic, conjugate, continuous fibers that form the fiber bundle will be manifested, that is, the cross sectional structure of the fibers will produce a spiral crimp, so the force of this manifestation opens up the fiber bundle extremely well, and because the resulting spread web comprises thermoplastic, conjugate, continuous fibers with a spiral crimp, it has high bulk and excellent soft touch.

Therefore, the present invention is a fiber bundle with a total denier of 10,000 to 500,000 dtex, obtained by bundling thermoplastic, conjugate, continuous fibers that have a single filament denier of 0.5 to 100 dtex/f and in which the center of gravity of conjugate components varies among the conjugate components in a fiber cross section, wherein the thermoplastic, conjugate, continuous fibers that make up the fiber bundle have a spontaneous crimp of 8 to 30 crimps per 2.54 cm, the fiber bundle density as defined by D1/(W1×L1) (where D1 is the total denier, W1 is the fiber bundle width, and L1 is the fiber bundle thickness) is 100 to 2000 dtex/mm$^2$, and the density ratio by spreading (the web density/fiber bundle density after spreading by drawing to a ratio of 1.6 in a spreading machine having a pinch roller at a rate of 25 m/min and a fiber bundle temperature of 25° C.) is 0.10 or less.

In the above-mentioned fiber bundle, it is good if the elongation of the thermoplastic, conjugate, continuous fibers is at least 70%.

Examples of the conjugate form of the thermoplastic, conjugate, continuous fibers include fiber cross sections that have an eccentric sheath-core structure, a side-by-side structure, or a multilayer structure. An eccentric sheath-core structure is a particularly good example. If the thermoplastic, conjugate, continuous fibers have an eccentric sheath-core structure, it is good if the eccentricity of the core component is at least 0.2.

The present invention is also a method for manufacturing a web, comprising a step of drawing and spreading the above-mentioned fiber bundle. More specifically, it is a method for manufacturing a web, comprising a step of spreading the above-mentioned fiber bundle at a draw ratio of 1.4 to 3.0.

The present invention is also directed at a web with a total denier of 10,000 to 1,000,000 dtex, in which thermoplastic, conjugate, continuous fibers that have a single filament denier of 0.5 to 100 dtex/f and in which the center of gravity of conjugate components varies among the conjugate components in a fiber cross section are aligned in a single direction, wherein the thermoplastic, conjugate, continuous fibers have a spiral crimp of 10 to 100 crimps per 2.54 cm, and the web density as defined by D2/(W2×L2) (where D2 is the total denier, W2 is the web width, and L2 is the web thickness) is 5 to 80 dtex/mm$^2$. In the web of the present invention, an apparent fiber length of the fibers making up the web and the web length in a direction of fiber length are generally identical. Herein, the apparent fiber length or apparent length of fiber denotes the length of fiber under no loading, but not the length of fiber in the condition of flattening crimps under a loading.

Examples of the conjugate form of the thermoplastic, conjugate, continuous fibers include fiber cross sections that have an eccentric sheath-core structure, a side-by-side structure, or a multilayer structure. If the thermoplastic, conjugate, continuous fibers have an eccentric sheath-core structure, it is good if the eccentricity of the core component is at least 0.2.

This web can be obtained by spreading the above-mentioned fiber bundle by drawing it at a ratio of 1.4 to 3.0.

The present invention is further directed at a member obtained using the above-mentioned web. A web in which the thermoplastic, conjugate, continuous fibers have a spiral crimp of over 100 crimps per 2.54 cm, and the web density as defined by D2/(W2×L2) (where D2 is the total denier, W2 is the web width, and L2 is the web thickness) is 10 to 100 dtex/mm$^2$ can be obtained by heat treating the above-mentioned web in which the fibers have a spiral crimp of 10 to 100 crimps per 2.54 cm, and the web density as defined by D2/(W2×L2) (where D2 is the total denier, W2 is the web width, and L2 is the web thickness) is 5 to 80 dtex/mm$^2$. The obtained web is suitable as a stretchable member. The temperature at which the web is heat treated here is favorably 80 to 125° C.

The present invention is further directed at a product obtained using the above-mentioned web or member. This product is, for example, one in which the above-mentioned web, in which the fibers have a spiral crimp of over 100 crimps per 2.54 cm, and the web density as defined by D2/(W2×L2) (where D2 is the total denier, W2 is the web width, and L2 is the web thickness) is 10 to 100 dtex/mm$^2$, is integrated by a plurality of partial heat bonding portions to another web or a sheet having no spiral crimps, or to another web or a sheet having fewer than 100 spiral crimps per 2.54 cm, and a loop in which the other web or sheet sticks out is formed between the partial heat bonding portions.

The present invention is also a product wherein a plurality of the above-mentioned members, in which the apparent length of the fibers that make up the member is between 3 and 50 mm, are heat-bonded by parts of the members to a web or sheet serving as a base.

The present invention is further directed at a finished product obtained using the above-mentioned web, member, or product.

The fiber bundle of the present invention, in which thermoplastic, conjugate, continuous fibers in which the center of gravity of the conjugate components varies among the conjugate components in a fiber cross section are aligned in a single direction, is bundled in a state of high fiber density prior to the spreading of the fiber bundle, and can be packed well into a packaging container and easily pulled up from a packaging container. In the subsequent spreading step, the cross sectional structure of the fibers will produce a spiral crimp, so the bundle opens extremely well. The fiber bundle of the present invention can be drawn and spread to obtain a web with particularly good touch and very high bulk. For example, the web density will be between 5 and 80 dtex/mm$^2$.

The spread web of the present invention, in which thermoplastic, conjugate, continuous fibers in which the center of gravity of the conjugate components varies among the conjugate components in a fiber cross section are aligned in a single direction, has high bulk and excellent soft touch because the thermoplastic, conjugate, continuous fibers have a spiral crimp. The web of the present invention is also suited to additional processing because the thermoplastic, conjugate, continuous fibers of which it is made up have a latent crimp. Thus, the web of the present invention can be used favorably in the surface layer of absorbent products, wiping members, filters, and so forth that will take advantage of the web's high bulk and good touch, its fine spiral crimping characteristics, and its latent crimping. Products with a softness can be produced from the web of the present invention, and it can be processed into finished products such as the surface layer of disposable diapers, sanitary napkins, and other such absorbent products, bandage pads and perspiration absorbent pads, poultices, sheets that soak up liquids, wiping members such as wipers and mops, air filters, and liquid filters.

BEST MODE FOR CARRYING OUT THE INVENTION

Figure 1:
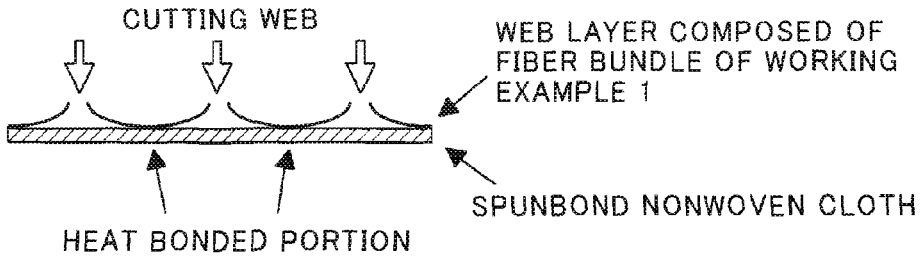
FIG. 1 schematically illustrates a cross section of a member obtained in Working Example 6, prior to heat treatment.

The present invention will now be described in detail through embodiments of the invention.

The fiber bundle of the present invention is characterized by being made up of thermoplastic, conjugate, continuous fibers that are bundled while aligned in the same direction.

The thermoplastic, conjugate, continuous fibers are obtained by conjugating and melt spinning polyethylene, polypropylene, binary to quaternary copolymers of propylene as a main constituent and other α-olefins, polymethylpentene and other such polyolefns, polyamides typified by nylon 6, nylon 66, or the like, polyesters typified by polyethylene terephthalate, polybutylene terephthalate, polyester elastomers, low-melting point polyesters obtained by copolymerizing isophthalic acid or the like as the acid component, or the like, fluororesins, and so forth. There are no particular restrictions on the number of components conjugated, and the material may be a component of two components, or of three or more components, with no problems either way. Also, the above-mentioned thermoplastic resins may be used singly or in mixtures of two or more types.

From the standpoint of being able to impart heat sealing or other aspects of heat bonding to the thermoplastic, conjugate, continuous fibers that make up the fiber bundle, conjugating components with different melting points is preferable, and this melting point differential is preferably at least 20° C., and even more preferably at least 50° C. It is preferable for the melting point differential to be at least 20° C. because heat bonding can be accomplished without any pronounced heat shrinkage of the high-melting point components. It is even more favorable for the melting point differential to be at least 50° C. because the heat bonding temperature can be set higher, so heat sealing will take less time, and this boosts productivity.

A good way to obtain a high-bulk web is to use a resin that is resistant to agglutination in the crimping step and that readily manifests spiral crimping when drawn in the spreading step. From this standpoint, it is better for the crystallinity of the thermoplastic resin that forms the fiber surface to be higher. Specifically, among the various polyethylenes available, it is better to use a high-density polyethylene rather than a low-density polyethylene or a linear low-density polyethylene. In the case of a polypropylene-based thermoplastic resin, it is better to use a polypropylene obtained by the homopolymerization of propylene rather than a binary to quaternary copolymer of propylene and other α-olefins.

Examples of such combinations include high-density polyethylene/polypropylene, high-density polyethylene/polyethylene terephthalate, and polypropylene/polyethylene terephthalate.

The weight ratio between the high-melting point component and the low-melting point component of these thermoplastic, conjugate, continuous fibers is such that the high-melting point component accounts for 10 to 90 wt % and the low-melting point component for 10 to 90 wt %, and preferably such that the high-melting point component accounts for 30 to 70 wt % and the low-melting point component for 70 to 30 wt %. It is preferable for the high-melting point component to account for at least 10 wt % because heat sealing or other such heat bonding can be accomplished without excessive shrinkage of the thermoplastic, conjugate, continuous fibers. Also, it is preferable for the low-melting point component to account for at least 10 wt % because satisfactory heat bonding strength can be achieved. If the high-melting point component and low-melting point component both account for between 10 and 90 wt %, an excellent balance will be struck between bonding strength and shape retention during heat bonding, and this balance will be even better if the high-melting point component and low-melting point component both account for between 30 and 70 wt %.

The thermoplastic, conjugate, continuous fibers that make up the fiber bundle of the present invention are characterized in that the center of gravity of the conjugate components varies among the conjugate components in a fiber cross section. These thermoplastic, conjugate, continuous fibers have a latent crimp that is attributable to this cross sectional structure, and this crimp is manifested when the fibers are subjected to drawing, heat treatment, or the like. There are no particular restrictions on the form of conjugating as long as the center of gravity of the conjugate components varies among the conjugate components in a fiber cross section, but examples include an eccentric sheath-core structure, a side-by-side structure, or a multilayer structure of three or more components. Of these, an eccentric sheath-core structure is particularly favorable when we take into account the soft touch and surface friction characteristics of the fibers, heat sealing characteristics, and so forth. Because the low-melting point component covers the fiber surface in the case of an eccentric sheath-core structure, the product has the softness originating in the low-melting component, and heat sealing and other such heat bonding are also excellent. There are no particular restrictions on the shape of the fiber cross section, which may be circular, hollow, or non-circular, and various cross sectional shapes can be obtained by suitably selecting the shape of the spinneret.

When the cross section of the thermoplastic, conjugate, continuous fibers has an eccentric sheath-core structure, the eccentricity of the core component that is the high-melting point component is preferably at least 0.2, and even more preferably at least 0.3. The eccentricity here can be calculated from the following equation using a micrograph of the fiber cross section or the like.

$$\text{Eccentricity}(h)=d/r$$

r: radius of overall fiber d: distance from center point of overall fiber to center point of core component The eccentricity can be adjusted by varying the design of the nozzle used in melt spinning, the type of thermoplastic resins that are conjugated, the melt flow rate, the temperature conditions during melt spinning, and so on, but eccentricity affects how the spiral crimping is manifested by drawing of the fiber bundle in the spreading step. A fiber bundle made up of thermoplastic, conjugate, continuous fibers whose eccentricity is at least 0.2 will have good spiral crimp manifestation, so it will open up well and have excellent soft touch and high bulk. These characteristics will be particularly good if the eccentricity is at least 0.3.

The fiber bundle of the present invention may be made up of a single type of thermoplastic, conjugate, continuous fibers, or may be made up of two or more types of thermoplastic, conjugate, continuous fibers. There are no particular restrictions on the mixture form if the bundle is made up of two or more types of thermoplastic, conjugate, continuous fibers, and the types may be randomly mixed, or mixed in parallel in the width direction of the fiber bundle, or mixed so as to be laminated in the thickness direction of the fiber bundle. Examples of different types of thermoplastic, conjugate, continuous fibers include those that differ in their resin makeup, cross sectional shape, single filament size, single filament elongation, number of crimps, eccentricity, and coloring.

To the extent that the effect of the present invention is not compromised, the thermoplastic resin used as the raw material for the thermoplastic, conjugate, continuous fibers that make up the fiber bundle of the present invention may contain antioxidants, light stabilizers, UV absorbents, neutralizers, nucleators, epoxy stabilizers, lubricants, bactericides, deodorants, flame retardants, anti-static agents, pigments, plasticizers, other thermoplastic resins, and so on.

An example of the method for manufacturing the fiber bundle of the present invention will now be given.

The fiber bundle of the present invention is usually manufactured by using an ordinary melt spinning machine, and the conjugating spinneret can be a standard side-by-side type, eccentric sheath-core type, multilayer type, or the like. The spinning temperature is preferably between 200° C. and 330°

C., and it is good for the take-up rate to be about 300 to 1500 m/min. The desired number of undrawn filaments obtained in this way are bundled together and introduced into a drawing machine, where they are suitably subjected to drawing and/or heat treatment, and then guided to a crimping step. It is usually preferable for the draw ratio here to be about 1.2 to 9.0. There are no particular restrictions on the drawing temperature or the heat treatment temperature, which can be suitably selected according to the stability of the drawing step, the heat shrinkage characteristics of the thermoplastic, conjugate, continuous fibers obtained by drawing, the additional processing characteristics, and so forth, but usually a high temperature is preferred so long as the thermoplastic, conjugate, continuous fibers do not fuse together.

The specified single filament denier of the thermoplastic, conjugate, continuous fibers in the fiber bundle of the present invention and the specified total denier of said fiber bundle can be achieved by suitably selecting the various conditions in the course of manufacturing the fiber bundle.

The single filament denier of the thermoplastic, conjugate, continuous fibers that make up the fiber bundle of the present invention is 0.5 to 100 dtex/f, and preferably 1.0 to 70 dtex/f, and even more preferably 2.0 to 30 dtex/f. If the single filament denier is at least 0.5 dtex/f, the strength had by a single fiber will be high, there will be less filament breakage during spreading, and the spreading can be performed at higher productivity. If the single filament denier is 100 dtex/f or less, bundling of the fibers will be better, there will be less entanglement when the fiber bundle is pulled up, and spreading will be enhanced. If the single filament denier is between 1.0 and 70 dtex/f, then fiber strength will be even higher, the bundling of the fibers will be better, and spreading will be further enhanced, and if the range is from 2.0 to 30 dtex/f, fiber strength will be even higher, the bundling of the fibers will be better, and spreading will be further enhanced.

The fiber bundle of the present invention has a total denier of 10,000 to 500,000 dtex, and preferably 20,000 to 300,000, and even more preferably 40,000 to 200,000 dtex. If the total denier is-at-least 10,000 dtex, there willbe an adequate number of thermoplastic, conjugate, continuous fibers that make up the fiber bundle, bundling will be enhanced, and there will be less unevenness during spreading. If the total denier is 500,000 dtex or less, there will be less twisting, knotting, and tangling of the fiber bundle, Therefore, if the total denier is within a range of 10,000 to 500,000 dtex, stable processing can be performed without problem, and it is preferable for the range to be from 20,000 to 300,000 dtex, and even more preferably from 40,000 to 200,000 dtex, because processing can be carried out at a higher speed.

The thermoplastic, conjugate, continuous fibers that make up the fiber bundle of the present invention are crimped, and the number of crimps is 8 to 30 per 2.54 cm, and preferably 10 to 20 per 2.54 cm, and even more preferably 12 to 18 per 2.54 cm. If the number of crimps is at least 8 per 2.54 cm, the fibers will bundle well and can be packed well into a packaging container, there will be less tangling of the fiber bundle or splitting and loosening between fibers when the fiber bundle is pulled up from a packaging container, and there will be no adverse effect on the spreading step. If the number of crimps is no more than 30 per 2.54 cm, there will be no decrease in how well the bundle can be spread due to excessive tangling of the thermoplastic, conjugate, continuous fibers, and once again an adverse effect on the spreading step can be avoided. Also, if an attempt is made to impart more than 30 crimps per 2.54 cm, the crimper will need to apply excessive pressure to the thermoplastic, conjugate fibers, and this may lower the uniformity of the crimping or cause the fibers to stick together. There are no particular restrictions on the shape of the crimps, examples of which include a serrated zigzag crimp, an Ω-shaped crimp, and a spiral crimp, but if we take into account how well the fibers can be bundled, how well they can be packed into a packaging container, how well they can be pulled up from a packaging container, and so forth, a serrated zigzag crimp or an Ω-shaped crimp is particularly favorable.

There are no particular restrictions on how the crimps are imparted, but examples include a method in which a stuffer box crimper is used, a method in which a gas is pushed in by high-temperature, high-pressure steam or by heated and pressurized air, and a method in which crimps are imparted by pushing a bundle of fibers in between a pair of high-speed rotating members such as with a high-speed crimper. Also, zigzag crimps can be imparted by one of the above crimping methods, then the bundle can be heat treated to produce minute changes in the crimps and thereby achieve an Ω-shaped crimp.

The surface of the thermoplastic, conjugate, continuous fibers that make up the fiber bundle of the present invention is preferably treated with a fiber treatment agent, and while there are no particular restrictions on the amount in which the agent is applied, 0.01 to 1.5 wt % is preferable. The function of the fiber treatment agent will be adequately exhibited as long as the fiber treatment agent adheres in an amount of at least 0.01 wt %. It is also preferable for the fiber treatment agent to adhere in an amount of no more than 1.5 wt % because no problems will be encountered in the subsequent spreading step as a result of stickiness attributable to the fiber treatment agent. Nor are there any particular restrictions on the type of fiber treatment agent, and various kinds of fiber treatment agent can be selected according to the intended application, such as agents for rendering the fibers hydrophilic or water-repellent, or for reducing-friction, improving bundling, and so on. In particular, as described in JP KOKAI No. 2006-002329, in the case of a fiber bundle made up of thermoplastic, conjugate, continuous fibers treated with a nonionic fiber treatment agent containing as its main component at least one compound selected from the group consisting of sorbitan fatty acid esters and polyoxyalkylene alkyl ether fatty acid esters, the fibers can be easily given an electrical charge by subjecting them to an electret treatment, friction treatment, or the like, and such a fiber bundle can be used to advantage as a member of a filter or wiper that collects dust extremely well.

The fiber bundle of the present invention is such that the fiber bundle density defined as follows is from 100 to 2000 dtex/mm$^2$, and preferably 200 to 1800 dtex/mm$^2$, and even more preferably 400 to 1500 dtex/mm$^2$.

$$\text{fiber bundle density}=D1(W1\times L1)$$

D1 here is the total denier of the fiber bundle (dtex), W1 is the width of the fiber bundle prior to spreading (units: mm), and L1 is the thickness of the fiber bundle prior to spreading (units: mm).

If the fiber bundle density is too low, the fibers will not bundle well, the fibers that make up the fiber bundle may split apart and the resulting single filaments may become entangled, causing knotting and tangling of fiber bundles. Even after the fiber bundles have been packaged, vibration during shipping or movement can cause knotting and tangling of fiber bundles. Any such knotting and tangling of fiber bundles adversely affects stability when the fiber bundles are pulled up from a packaging container. Also, splitting between the fibers that make up the fiber bundle is linked to less uniform spreading of the fiber bundle, making it impossible to obtain a web having uniform web density and bulk. To avoid these problems, the fiber bundle density is preferably at least 100 dtex/mm$^2$. On the other hand, if the fiber bundle density is too high, it may be impossible to obtain a fiber bundle composed of thermoplastic, conjugate, continuous fibers that have been uniformly crimped. And even if such a bundle can be obtained, since excessive pressure is applied to the thermoplastic, conjugate fibers during the crimping step, the fibers can stick together, which once again leads to less uniform spreading of the fiber bundle, making it impossible to obtain a web having uniform web density and bulk. To avoid these problems, the fiber bundle density is preferably no more than 2000 dtex/mm$^2$. If the fiber bundle density is between 100 and 2000 dtex/mm$^2$, the fibers will bundle well, the bundles can be pulled up well from a packaging container, and the spreading of the fiber bundle will be uniform. A range of 200 to 1800 dtex/mm$^2$ is better, and 400 to 1500 dtex/mm$^2$ is better yet.

The fiber bundle density is closely correlated to the volume of the crimp imparting portion in the crimping step and to the total denier of the fiber bundle, but also depends on the apparently existent crimp number imparted in the crimping step, the subsequent heat treatment temperature, and other factors. In other words, the fiber bundle density can be adjusted to within the above range by suitably selecting these conditions.

With the fiber bundle of the present invention, density ratio by spreading defined below is 0.10 or less, and preferably 0.08 or less, and even more preferably 0.06 or less.

density ratio by spreading=(web density/fiber bundle density)

(The above-mentioned density ratio by spreading is the density ratio after spreading the fiber bundle by drawing to a ratio of 1.6 in a pinch roller spreading machine at a rate of 25 mmin and a fiber bundle temperature of 25° C., and expresses the extent to which bulk is increased by spreading the bundle. The above spreading conditions are for measuring the density ratio by spreading of the fiber bundle, and the spreading conditions when the fiber bundle of the present invention is actually spread to obtain a web are not limited to the above, and various other conditions can be set.)

$$\text{fiber bundle density}=D1/(W1\times L1)$$

$$\text{web density}=D2/(W2\times L2)$$

D1 here is the total denier of the fiber bundle (units: dtex), W1 is the width of the fiber bundle prior to spreading (units: mm), L1 is the thickness of the fiber bundle prior to spreading (units: mm), D2 is the total denier of the web (units: dtex), W2 is the width of the web (units: mm), L2 is the thickness of the web (units: mm), and the above-mentioned fiber bundle density and web density are both values measured at 25° C.

If the density ratio by spreading of the fiber bundle is 0.10 or less, a spiral crimp will be manifested when the fiber bundle undergoes the spreading step, resulting in a change from a fiber bundle in a state of high fiber density to a web in a state of low fiber density. Specifically, a fiber bundle with a low density ratio by spreading is bundled in a state of high fiber density in the form of a fiber bundle, so it can be packed well into a packaging container and can be physical distributed more efficiently, and furthermore there will be fewer problems of the fiber bundles becoming tangled or knotted due to vibration and the like during physical distribution, and this makes it easier for the fiber bundles to be pulled up from a packaging container in the spreading step. Furthermore, a web obtained in the spreading step is in a state of low fiber density and has high bulk and excellent soft touch. This effect will be adequately manifested as long as the density ratio by spreading of the fiber bundle is 0.10 or less, but will be even more effective at 0.08 or less, and 0.05 or less is better still.

The fiber bundle of the present invention has a density ratio by spreading within the above numerical value ranges because the center of gravity of the conjugate components varies among the conjugate components in a fiber cross section, for example.

The thermoplastic, conjugate, continuous fibers that make up the fiber bundle of the present invention preferably have an elongation of at least 70%, and even more preferably at least 90%. If the elongation of the thermoplastic, conjugate, continuous fibers is high enough, there will be no single filament breakage or attendant roll winding or the like even if the fiber bundle is drawn to a high ratio (such as 1.6 times or higher) in the course of being spread, and a high-bulk web can be obtained stably and easily. Also, the processing speed can be raised in the spreading step, and productivity will also be higher. There are no particular restrictions on the method for achieving an elongation of at least 70%, and preferably at least 90%, in the thermoplastic, conjugate, continuous fibers, but one simple method is to draw the thermoplastic, conjugate, continuous fibers in the course of their production, to a lower ratio than their maximum draw ratio (the ratio at which drawing breakage occurs). There are no particular restrictions on the ratio of the actual draw ratio to the maximum draw ratio (actual draw ratio/maximum draw ratio), but this ratio is preferably between 0.4 and 0.7 because the elongation of the resulting thermoplastic, conjugate, continuous fibers can be raised without greatly lowering productivity.

When the above-mentioned fiber bundle of the present invention, which is made up of thermoplastic, conjugate, continuous fibers in which the center of gravity of the conjugate components varies among the conjugate components in a fiber cross section, is drawn and then this drawing tension is released, the latently crimp originating in the cross sectional structure of the thermoplastic, conjugate, continuous fibers is appeared, and spiral, three-dimensional crimping occurs. At this time, a dispersive force in the thickness and width directions produced by the manifestation of spiral crimping acts on the fiber bundle, and this causes the volume to expand and opens the fiber bundle with high fiber density into a web with low fiber density. The spread web obtained in this way consists of thermoplastic, conjugate fibers having a spiral crimp, and is therefore characterized by a softness and extremely high bulk.

The draw ratio in the spreading step is preferably 1.4 to 3.0, and even more preferably 1.7 to 2.5. If the draw ratio is too low, the crimps in the thermoplastic, conjugate, continuous fibers that make up the fiber bundle will just be stretched out, there will be no tension in the axial direction of the thermoplastic, conjugate, continuous fibers, and either no spiral crimp will be manifested, or the extent of manifestation will be inadequate. The web thus obtained tends to be narrow in width, and also tends to have poor touch and bulk. To avoid these problems, the draw ratio is preferably at least 1.4. On the other hand, if the draw ratio is too high, the thermoplastic, conjugate, continuous fibers will be subjected to excessive tension, leading to single filament breakage or attendant roll winding. To avoid these problems, the draw ratio is preferably no higher than 3.0. If the draw ratio is between 1.4 and 3.0, good spiral crimping will be manifested without single filament breakage occurring, and a web having an adequate width, high bulk, and a good touch will be obtained, but it is even better for the draw ratio to be between 1.7 and 2.5 because the draw rate can be raised, that is, the line speed in the spreading step can be higher.

There are no particular restrictions on the method for drawing and spreading the fiber bundle of the present invention, but examples include a method in which tension is imparted to the fiber bundle between rolls with a speed differential, after which the fibers elastically contract to impart elongation and shrinkage at the crimps, a method in which a threaded roll, in which a groove extending in the peripheral direction is formed at a specific spacing in the axial direction, is rotated, and the fiber bundle is supplied to the surface of this roll and spread, and a method in which the fiber bundle is spread by blowing an air jet against it. Of these methods, one in which spreading is accomplished by using rolls with a speed differential is preferred from the standpoint that it allows the thermoplastic, conjugate, continuous fibers that make up the fiber bundle to be suitably drawn. There are no particular restrictions on the roll speed ratio here, but over a range of 1.4 to 3.0, the fiber bundle of the present invention can be spread at good productivity, and the web obtained by this spreading will manifest a suitable spiral crimp, have high bulk, and have a softness.

When the fiber bundle of the present invention is drawn and spread, a plurality of fiber bundles may be spread at the same time, at which time the fiber bundles may all be of the same type, or different kinds of fiber bundle may be combined. Examples of different kinds of fiber bundle include fiber bundles with different resin makeup, fiber bundles with different single filament denier, fiber bundles with different total denier, fiber bundles with different crimp numbers of the thermoplastic, conjugate, continuous fibers, fiber bundles with different fiber bundle density, and fiber bundles with different eccentricity of the core components of the thermoplastic, conjugate, continuous fibers.

There are no particular restrictions on the temperature of the fiber bundle during the drawing and spreading of the fiber bundle of the present invention, but a range of 20 to 120° C. is preferable. If the fiber bundle temperature is too low, the single filaments will be prone to breaking during drawing, and the processability will be decreased. If the fiber bundle temperature is too high, however, the thermoplastic, conjugate, continuous fibers will tend to stick together, and the processability will be decreased. If the temperature is between 20 and 120° C., the bundle can be spread at a satisfactory level of processability, and within this range the temperature can be suitably set according to the required web properties and performance of the finished product. For instance, if the temperature of the fiber bundle is from 20 to 40° C., drawing will result in a more pronounced manifestation of spiral crimping, the crimp number will be higher, and finer spiral crimps will be obtained. If the temperature is from 40 to 80° C., the manifestation of spiral crimping will be medium, and a web will be obtained with a good touch and excellent bulk recovery when the web is compressed and then released. If the temperature is from 80 to 120° C., the manifested spiral crimps will have a larger pitch, and a web that is wider and has high bulk will be obtained. There are no particular restrictions on the method for keeping the fiber bundle temperature within the above range, but examples include a method in which the fiber bundle is passed through a box adjusted to the desired temperature, a method in which hot air of the desired temperature is blown against the fiber bundle, and a method in which the fiber bundle is brought into contact with a hot plate or roll of the desired temperature:

When the fiber bundle of the present invention is spread as above, the result is a web in which thermoplastic, conjugate, continuous fibers are aligned in the same direction.

The present invention also relates to this web, and in specific terms the present invention is directed at a web with a total denier of 10,000 to 1,000,000 dtex, in which thermoplastic, conjugate, continuous fibers that have a single filament denier of 0.5 to 100 dtex/f and in which the center of gravity of conjugate components varies among the conjugate components in a fiber cross section are aligned in a single direction, wherein the thermoplastic, conjugate, continuous fibers have a spiral crimp of 10 to 100 crimps per 2.54 cm, and the web density as defined by D2/(W2×L2) (where D2 is the total denier, W2 is the web width, and L2 is the web thickness) is 5 to 80 dtex/mm$^2$. In the web of the present invention, an apparent fiber length of the fibers making up the web and the web length in a direction of fiber length are generally identical. Herein, the apparent fiber length or apparent length of fiber denotes the length of fiber under no loading, but not the length of fiber in the condition of flattening crimps under a loading.

There are no particular restrictions on the characteristic of the fiber bundle serving as the raw material of the above-mentioned web of the present invention. And the raw material of the web can be either the fiber bundle of the present invention, or another fiber.

The thermoplastic, conjugate, continuous fibers that make up the web of the present invention are obtained by conjugating and melt spinning a thermoplastic resin, and while there are no particular restrictions on the type of thermoplastic resin used, examples include the same group of resins as those listed above as the components of the thermoplastic, conjugate, continuous fibers that make up the fiber bundle. There are no particular restrictions on the number of components conjugated, it may be two, three or more components, with no problems either way. Also, the above-mentioned thermoplastic resins may be used singly or in mixtures of two or more types. From the standpoint of being able to impart heat sealing or other aspects of heat bonding properties to the fiber bundle that makes up the web, conjugating components with different melting points is preferable, and this melting point differential is preferably at least 20° C., and even more preferably at least 50° C. It is preferable for the melting point differential to be at least 20° C. because heat bonding can be accomplished without any pronounced heat shrinkage of the high-melting point components. It is even more favorable for the melting point differential to be at least 50° C. because the heat bonding temperature can be set higher, so heat sealing will take less time, and this boosts productivity. From the standpoint of obtaining a high-bulk web, which is a characteristic of the present invention, it is good to use a resin that is resistant to agglutination in the crimping step and that readily manifests spiral crimping when drawn in the spreading step. From this standpoint, it is better for the crystallinity of the thermoplastic resin that forms the fiber surface to be higher. Specifically, among the various polyethylenes available, it is better to use a high-density polyethylene rather than a low-density polyethylene or a linear low-density polyethylene. In the case of a polypropylene-based thermoplastic resin, it is better to use a polypropylene obtained by the homopolymerization of propylene rather than a binary to quaternary copolymer of propylene as a primary comononer and other α-olefins.

Examples of such combinations include high-density polyethylene/polypropylene, high-density polyethylene/polyethylene terephthalate, and polypropylene/polyethylene terephthalate.

There are no particular restrictions on the weight ratio between the high-melting point component and the low-melting point component of the thermoplastic, conjugate, continuous fibers that make up the web of the present invention, but the weight ratio ranges given above as the weight ratio between the high-melting point component and the low-melting point component of the thermoplastic, conjugate, continuous fibers that make up the fiber bundle can also be given as examples here.

To the extent that the effect of the present invention is not compromised, the thermoplastic resin used as the raw material for the thermoplastic, conjugate, continuous fibers that make up the web of the present invention may contain antioxidants, light stabilizers, UV absorbents, neutralizers, nucleators, epoxy stabilizers, lubricants, bactericides, deodorants, flame retardants, anti-static agents, pigments, plasticizers, other thermoplastic resins, and so on.

The preferable single filament denier of the thermoplastic, conjugate, continuous fibers that make up the web of the present invention is 0.5 to 100 dtex/f, and more preferably 1.0 to 70 dtex/f, and even more preferably 2.0 to 30 dtex/f. If the single filament denier is at least 0.5 dtex/f, the strength had by a single fiber will be high enough, there will be less filament breakage and pilling during processing into a finished product by heat sealing or cutting the web. If the single filament denier is 100 dtex/f or less, there will be an adequate number of fibers that make up the web, bulk will be high, the fibers will be soft, and the web will have softness, and can therefore be used in a wide range of applications. If the single filament denier is between 0.5 and 100 dtex/f, then web properties such as high bulk and good touch, and good productivity in processing the web into a finished product can both be achieved, and if the range is from 1.0 to 70 dtex/f, the effect will be even better, and if the range is from 2.0 to 30 dtex/f, the effect will be better yet.

The total denier of the web of the present invention is preferably 10,000 to 1,000,000 dtex, and more preferably 20,000 to 600,000 dtex, and even more preferably 40,000 to 400,000 dtex. If the total denier of the web is at least 10,000 dtex, there will an adequate number of thermoplastic, conjugate, continuous fibers that make up the web, and the web will have high bulk and a good feel of volume. On the other hand, if the total denier of the web is no higher than 1,000,000 dtex, a cost-effective increase in bulk and feel of volume can be maintained without making the total denier too large. The web of the present invention may be obtained by spreading a single fiber bundle, or may be obtained by spreading a plurality of fiber bundles and stacking or aligning them. In other words, if the goal is obtaining a web with a total denier of 300,000 dtex, for example, a single fiber bundle with a total denier of 300,000 dtex may be spread, or three fiber bundles whose total denier of each is 100,000 dtex may be spread respectively and these bundles stacked in the thickness direction or aligned in the width direction.

If the web of the present invention is obtained by spreading a plurality of fiber bundles at the same time, the fiber bundles may all be of the same type, or different kinds of fiber bundle may be combined. Examples of different kinds of fiber bundle include fiber bundles with different resin makeup, fiber bundles with different single filament denier, fiber bundles with different total denier, fiber bundles with different crimp numbers of the thermoplastic, conjugate, continuous fibers, fiber bundles with different fiber bundle density, and fiber bundles with different eccentricity of the core components of the thermoplastic, conjugate, continuous fibers.

The thermoplastic, conjugate, continuous fibers that make up the web of the present invention have a spiral crimp, and the number thereof is preferably 10 to 100 crimps per 2.54 cm, and more preferably 15 to 80 crimps per 2.54 cm. If the number of spiral crimps is at least 10 crimps per 2.54 cm, there will be enough crimps for the touch to be soft, and when the web is processed into a wiping member, for example, it will hold dirt well. Also, if there are no more than 100 crimps per 2.54 cm, the crimping will not cause the fibers to tangle too much and make it difficult for the fibers to be loosened one by one, allowing a good touch to be preserved. The soft touch of the web will be especially good if the number of crimps is between 15 and 80 crimps per 2.54 cm.

The web of the present invention is such that the web density defined as follows is from 5 to 80 dtex/mm$^2$, and preferably 10 to 50 dtex/mm$^2$.

$$\text{web density}=D2(W2\times L2)$$

D2 here is the total denier (dtex), W2 is the web width (units: mm), and L2 is the web thickness (units: mm).

If the web density is at least 5 dtex/mm$^2$, there will be enough fibers per unit of volume for the web to have a good feel of volume. If the web density is 80 dtex/mm$^2$ or less, a softness can be preserved without having to use more fibers per unit of volume than necessary. It is particularly favorable for the web density to be between 10 and 50 dtex/mm$^2$ because the web will strike a good balance between bulkiness, feel of volume, and softness.

The thermoplastic, conjugate, continuous fibers that make up the web of the present invention are characterized in that the center of gravity of the conjugate components varies among the conjugate components in a fiber cross section. These thermoplastic, conjugate, continuous fibers have a latent crimp that is attributable to this cross sectional structure, and additional processing can be performed in which this latent crimp is developed into a spiral crimp and the structure and softness of the web are changed. For example, if heat is applied by exposure to steam or hot air, or by dipping in hot water, the difference in the heat shrinkage between the various compound components causes an even finer spiral crimp to appear and the fibers to shrink. The fibers can be similarly shrunken by utilizing a difference in elastic shrinkage. There are no particular restrictions on the form of conjugating as long as the center of gravity of the conjugate components varies among the conjugate components in a fiber cross section, but examples include an eccentric sheath-core structure, a side-by-side structure, or a multilayer structure of three or more components. Of these, an eccentric sheath-core structure is particularly favorable when we take into account the softness and surface friction characteristics of the fibers, heat sealing characteristics, and so forth. Because the low-melting component covers the fiber surface in the case of an eccentric sheath-core structure, the product has the softness originating in the low-melting component, and heat sealing and other such heat bonding are also excellent. There are no particular restrictions on the shape of the fiber cross section, which may be circular, hollow, or non-circular, and various cross sectional shapes can be obtained by suitably selecting the shape of the spinneret.

When the cross section of the thermoplastic, conjugate, continuous fibers has an eccentric sheath-core structure, the eccentricity of the core component (the high-melting point component), is preferably at least 0.2, and more preferably at least 0.3. The eccentricity here is defined the same as discussed above.

The eccentricity can be adjusted by varying the design of the nozzle used in melt spinning, the type of thermoplastic resins that are conjugated, the melt flow rate, the temperature conditions during melt spinning, and so on. The spiral crimp may not be sufficiently manifested and additional processing involving heat shrinkage will tend to be inferior if the eccentricity is less than 0.2. Thus, when a cross section of the thermoplastic, conjugate, continuous fibers that make up the web of the present invention is an eccentric sheath-core cross section, for the web to lend itself to the desired crimp manifestation and additional processing, its eccentricity is preferably at least 0.2, and the effect will be even better if the eccentricity is at least 0.3.

The thermoplastic, conjugate, continuous fibers that make up the web of the present invention have a spiral crimp, and this web exhibits bulkiness and softness. Furthermore, since these thermoplastic, conjugate, continuous fibers have a latent crimp, the web is also suited to various kinds of additional processing. These characteristics can be taken advantage of when the web of the present invention is processed into any of various finished products. Examples of such finished products include the surface layer of disposable diapers, sanitary napkins, and other such absorbent products, bandage pads and perspiration absorbent pads, poultices, sheets that soak up liquids, wiping members such as wipers and mops, air filters, and liquid filters, but the present invention is not particularly limited to these examples.

There are no particular restrictions on how the above-mentioned finished products are obtained from the web of the present invention, but as an example, the web of the present invention, made up of thermoplastic, conjugate, continuous fibers, can be cut to the desired fiber length to obtain a finished product member, and this member can be processed into a finished product. There are no particular restrictions on the fiber length of the web that makes up this member, but the fibers can be cut to a length of 500 mm or less, for example, according to the intended application and how well the fibers are suited to processing. A member composed of the web of the present invention will have the same length as the apparent fiber length of the thermoplastic, conjugate, continuous fibers that make up the member, that is, the ends of the thermoplastic, conjugate, continuous fibers will only be present at the ends of the member. Thus, the web of the present invention, and a member composed thereof, will have a softness and none of the scratchiness attributable to the fiber ends, and can therefore be used favorably for the surface material of sanitary products and so forth. Also, when the web of the present invention, and a member composed thereof, is subjected to an embossing heat treatment or a partial heat sealing treatment, since the fiber length is the same as the length of the web or member, and the fibers are all oriented in the same direction, there will be less dropout of unbonded thermoplastic, conjugate fibers, it will be possible to reduce the surface area accounted for by the embossing points or heat sealed portions, and the material can be processed into a finished product without sacrificing bulk or softness. Specifically, when a web and a member obtained by carding staple fiber with a fiber length of 38 mm, for example, are subjected to an embossing heat treatment or a partial heat sealing treatment, the heat treatment must be carried out at least at intervals of 38 mm or less in the fiber orientation direction in order to prevent the thermoplastic, conjugate fibers from dropping out, that is, to prevent some of the thermoplastic, conjugate fibers from remaining unbonded, whereas with the web and member of the present invention, this heat treatment can be carried out at a sufficiently larger interval.

The result of heat treating the web of the present invention is a web with a total denier of 10,000 to 1,000,000 dtex, in which thermoplastic, conjugate, continuous fibers that have a single filament denier of 0.5 to 100 dtex/f and in which the center of gravity of conjugate components varies among the conjugate components in a fiber cross section, are aligned in the same direction, wherein the thermoplastic, conjugate, continuous fibers have a spiral crimp of over 100 crimps per 2.54 cm, and the web density as defined by $D2/(W2 \times L2)$ (where D2 is the total denier, W2 is the web width, and L2 is the web thickness) is 10 to 100 dtex/mm$^2$. Specifically, a stretchable web is obtained in which an extremely fine spiral crimp is manifested upon heat treatment, and the web is stretchable in the direction of fiber orientation because of the stretching force of the spiral crimp. When this stretchable web is subjected to an embossing heat treatment or a partial heat sealing treatment, a stretchable member in the form of a sheet is obtained. The stretchable web and stretchable member have both good stretchability and softness, and can be used favorably in poultice materials, the waistbands of disposable diapers, and so forth. There are no particular restrictions on the surface area accounted for by embossing points or heat sealed portions, but to achieve both a softness and good stretchability, 20% or less is preferable, and 10% or less is even better. There are no particular restrictions on the shape or layout of the embossing points or heat sealed portions, which can be selected as desired.

There are no particular restrictions on the extension recovery rate of the stretchable web and the stretchable member, but at least 60% is preferable, and at least 80% is even better. If the extension recovery rate is at least 60%, a product and a finished product that take advantage of the stretch characteristics can be obtained, and if the extension recovery rate is at least 80%, the resulting product and finished product will have even better stretch characteristics. To raise the extension recovery rate, it is preferable for there to be more spiral crimps. The above-mentioned extension recovery rate will be exhibited as long as there are at least 100 crimps per 2.54 cm, but it is preferable for there to be at least 150 crimps per 2.54 cm because the extension recovery rate will be even better. There is no upper limit to the number of crimps, but if it is a priority for the resulting stretchable web and stretchable member to have a softness, then it is preferable for there to be no more than 250 crimps per 2.54 cm. There are no particular restrictions on the heat treatment method used to obtain the stretchable web and stretchable member, and all heating media can be used, such as hot air, steam, and hot water, but using hot air is preferable because it will yield a stretchable web and stretchable member with superior softness. There are no particular restrictions on the temperature of the heat treatment, but a range of 80 to 125° C. is preferable, and 100 to 120° C. is even better. It is preferable for the heat treatment temperature to be at least 80° C. because the desired spiral crimps will be manifested and a stretchable web and stretchable member will be obtained in a shorter heat treatment time, that is, at higher productivity. It is preferable for the heat treatment temperature to be 125° C. or lower because the desired spiral crimping will be manifested and the stretchable web and stretchable member will be obtained without leading to a decrease in the softness of the web due to heat hardening. It is even better for the heat treatment temperature to be from 100 to 120° C. because this strikes a good balance between the softness of the web and productivity.

There are no particular restrictions on the method for obtaining the above-mentioned member, product and finished product from the web of the present invention, which may, for example, be obtained either by stacking a plurality of webs in the thickness direction, or by aligning a plurality of webs in the width direction. The webs that are combined may be all the same type, or may be different types, and the web may be combined with another material, such as pulverized pulp, a highly absorbent resin, a web of natural fibers, a film, a nonwoven cloth or another such sheet material, an air- and liquid-permeable sheet such as a perforated nonwoven cloth or a net, or a fibrous material such as Spandex or monofilaments. Specifically, for example, a finished product may be obtained by applying liquid paraffin or another such dust-trapping finishing agent to the web, then laminating the web with a film, a spunbond nonwoven cloth, or another such sheet material, and partially heat bonding the web and sheet by a heat sealing treatment.

A product wherein the above-mentioned web obtained by heat treatment, that is a web with a total denier of 10,000 to 1,000,000 dtex, in which thermoplastic, conjugate, continuous fibers that have a single filament denier of 0.5 to 100 dtex/f and in which the center of gravity of conjugate components varies among the conjugate components in a fiber cross section are aligned in a single direction, wherein the thermoplastic, conjugate, continuous fibers have a spiral crimp of over 100 crimps per 2.54 cm, and the web density as defined by D2/(W2×L2) (where D2 is the total denier, W2 is the web width, and L2 is the web thickness) is 10 to 100 dtex/mm$^2$, is integrated by a plurality of partial heat bonding portions to another web or a sheet having no spiral crimps, or to another web or a sheet having fewer spiral crimps than the above-mentioned web, and a loop in which the other web or sheet sticks out is formed between the partial heat bonding portions, has both stretchability and a wavy structure, and can be used favorably as a surface material in wipers, mops, and other such wiping members, sanitary materials, and so forth.

The above product is obtained by using as a first layer a web with a total denier of 10,000 to 1,000,000 dtex, in which thermoplastic, conjugate, continuous fibers that have a single filament denier of 0.5 to 100 dtex/f and in which the center of gravity of conjugate components varies among the conjugate components in a fiber cross section are aligned in a single direction, wherein the thermoplastic, conjugate, continuous fibers have a spiral crimp of 10 to 100 crimps per 2.54 cm, and the web density is 5 to 80 dtex/mm$^2$, said web being the subject of the present invention, and laminating this first layer with one or more layers of another web or a sheet which will not manifest any spiral crimps by a subsequent heat treatment, or another web or a sheet which will manifest fewer than 10 spiral crimps per 2.54 cm by a subsequent heat treatment, and these layers are integrated by an embossing heat treatment or a partial heat sealing treatment, and then the laminated layers of which is heat treated. Specifically, when these layers are heat treated, the first layer undergoes pronounced shrinkage of apparent length due to the manifestation of spiral crimping originating in the cross sectional shape of this first layer, whereas the layer of the other web or sheet laminated to the first layer does not shrink as much as the first layer, and the difference in the heat shrinkage of the two layers forms a loop in which the other web or sheet sticks out. There are no particular restrictions on the surface area accounted for by embossing points or heat sealed portions when the layers are integrated, but when stretchability and the softness of the product are taken into account, 20% or less is preferable, and 10% or less is even better. It is preferable for the surface area of the sealed portions to be 20% or less because the product will exhibit softness and good stretchability, and it is preferable for the area to be 10% or less because the softness and stretchability will be even better. There are no particular restrictions on the shape or pattern of the embossing points or heat sealed portions, which can be suitably selected according to the size of the textured structure to be obtained, the arrangement, and so forth. There are no particular restrictions on the heat treatment method used in forming the loop, and all heating media can be used, such as hot air, steam, and hot water, but using hot air and increasing how far the material sticks out is preferable in order to obtain better contrast in the textured structure. Also, there are no particular restrictions on the heat treatment temperature in forming the loop, but as discussed above, a range of 80 to 125° C. is preferable, and 100 to 120° C. is even better. It is preferable for the heat treatment temperature to be at least 80° C. because the desired spiral crimps will be manifested, and a product having a loop in which the web or sheet sticks out will be obtained, in a shorter heat treatment time, that is, at higher productivity. It is preferable for the heat treatment temperature to be 125° C. or lower because the desired spiral crimping will be manifested, and a product having a loop in which the web or sheet sticks out will be obtained, without leading to a decrease in the softness of the web due to heat hardening. It is even better for the heat treatment temperature to be from 100 to 120° C. because this strikes a good balance between the softness of the web and productivity.

There are no particular restrictions on the other web or sheet, but examples include a web obtained by a spunbond process, a melt blown process, carding, an air-laid process, screening, or the like, or a nonwoven cloth obtained by subjecting such a web to heat treatment, latex treatment, or an entangling treatment such as a spunlace or needle punch process, or a perforated nonwoven cloth obtained by subjecting a web or nonwoven cloth to a perforation treatment, or a film, net, weave, knit, or the like.

A product, wherein a plurality of members, in which the apparent length of the fibers that make up the member is between 3 and 50 mm and which are obtained using a web with a total denier of 10,000 to 1,000,000 dtex, in which thermoplastic, conjugate, continuous fibers that have a single filament denier of 0.5 to 100 dtex/f and in which the center of gravity of conjugate components varies among the conjugate components in a fiber cross section are aligned in a single direction, wherein the thermoplastic, conjugate, continuous fibers have a spiral crimp of over 100 crimps per 2.54 cm, and the web density as defined by D2/(W2×L2) (where D2 is the total denier, W2 is the web width, and L2 is the web thickness) is 10 to 100 dtex/mm$^2$, are heat-bonded by parts of the members to a web or sheet serving as a base, has protrusions that stick out on the surface of the web or sheet serving as a base, and has an extremely fine spiral crimp, and therefore perform very well at trapping dirt with a large particle size, such as sand, and can be used favorably as a wiper, mop, or other such wiping member.

The product is obtained by laminating on a web or sheet (serving as a base) the web of the present invention with a total denier of 10,000 to 1,000,000 dtex, in which thermoplastic, conjugate, continuous fibers that have a single filament denier of 0.5 to 100 dtex/f and in which the center of gravity of conjugate components varies among the conjugate components in a fiber cross section are aligned in a single direction, wherein the thermoplastic, conjugate, continuous fibers have a spiral crimp of 10 to 100 crimps per 2.54 cm, and the web density is 5 to 80 dtex/mm$^2$, integrating these layers by an embossing heat treatment or a partial heat sealing treatment or the like, then cutting the web, made up of the thermoplastic, conjugate, continuous fibers in which the center of gravity of the conjugate components varies among the conjugate components in a fiber cross section, between the embossing points or heat sealed portions, and heat treating the cut webs to heat-shrink them. Because of their cross sectional shape, the thermoplastic, conjugate fibers that make up the cut webs take on an extremely fine spiral crimp when heat treated, and this reduces their apparent length. Because the spiral crimp here develops three-dimensionally, the cut webs shrink in a form in which there is a considerable rise on the surface of the web or sheet serving as the base, and form protrusions. Furthermore, when the protrusions of this product are wiped over a floor or other such wiping surface, friction with the floor causes the protrusions to stick out, forming more pronounced protrusions.

There are no particular restrictions on the places where the thermoplastic, conjugate, continuous fibers are cut, so long as it is between bonded points such as embossing points or heat sealed portions, and the cut may be made at a middle position of bonded points, or at a position adjacent to a bonded point. When the cuts are made at middle positions, two protrusions are formed that are adjacent on the both side of the bonded point, and when the cuts are made at adjacent positions, a single protrusion is formed adjacent on the both side of the bonded point. There are no particular restrictions on the shrinkage ratio defined by the length from the bonded point to the cut position and the length from the bonded point to the cut end after heat treatment ({(length from bonded point to cut position−the length from the bonded point to the cut end after heat treatment)÷length from bonded point to cut position}×100), but at least 30% is preferable, and at least 50% is even better. A distinct protrusion will be formed if the shrinkage is at least 30%, and an adequate protrusion will be formed at 50% or higher. It is preferable that the apparent length of the cut web after heat treatment (the length from the cut end to end after heat treatment) is generally in the range of from 3 to 50 mm.

There are no particular restrictions on the proportional surface area of the embossed, heat sealed, or other sealed portions, but to obtain a product with a softness, and to increase the surface area of the protrusions per unit of product surface area, 20% or less is preferable, and 10% or less is even better. If the proportional surface area of the bonded points is 20% or less, a softness will be maintained and there will be many protrusions per unit of surface area, and if the value is 10% or less, even better softness will be exhibited and the surface area of the protrusions per unit of surface area is more increased. There are no particular restrictions on the shape or pattern of the embossing points or heat sealed portions, which can be suitably selected according to the size of the protrusions to be obtained, the arrangement, and so forth. There are no particular restrictions on the heat treatment method used in forming the protrusions, and all heating media can be used, such as hot air, steam, and hot water, but using hot air and make the protrusions stand up more is preferable in order to make the protrusions stick out farther.

There are no particular restrictions on the heat treatment temperature in forming the protrusions, but to form distinct protrusions, it is preferable to increase the shrinkage ratio defined by the length from the bonded point to the cut position and the length from the bonded point to the cut end after heat treatment, and this heat treatment temperature is preferably from 80 to 125° C., and more preferably 100 to 120° C. Just as discussed above, if the heat treatment temperature is at least 80° C., a product in which the desired spiral crimps are manifested, and in which protrusions that rise up distinctly from the web or sheet serving as a base are formed, will be obtained in a shorter heat treatment time, that is, at higher productivity. It is preferable for the heat treatment temperature to be 125° C. or lower because the desired spiral crimping will be manifested and a product having protrusions that rise up distinctly from the web or sheet serving as a base will be obtained without leading to a decrease in the softness of the web due to heat hardening. It is even better for the heat treatment temperature to be from 100 to 120° C. because this strikes a good balance between the softness of the web and productivity.

There are no particular restrictions on the web or sheet serving as a base, but examples include a web obtained by a spunbond process, a melt blown process, carding, an air-laid process, screening, or the like, or a nonwoven cloth obtained by subjecting such a web to heat treatment, latex treatment, or an entangling treatment such as a spunlace or needle punch process, or a perforated nonwoven cloth obtained by subjecting a web or nonwoven cloth to a perforation treatment, or a film, net, weave, knit, or the like.

There are no particular restrictions on the method for obtaining a finished product from the member or product of the present invention, but, for example, a finished product may be obtained by combining a plurality of members or products, and the combined members or products may be all the same type, or may be different types. Also, the member or product of the present invention may be combined with other materials to obtain a finished product. Examples of other materials include the above-mentioned pulverized pulp, a highly absorbent resin, a web of natural fibers, a film, a nonwoven cloth or another such sheet material, an air- and liquid-permeable sheet such as a perforated nonwoven cloth or a net, or a fibrous material such as Spandex or monofilaments.

WORKING EXAMPLES

The present invention will now be described by giving working examples, but is not limited by these examples. Definitions and methods for measuring properties in the working examples are given below.

(1) Single Filament Denier

Measured according to JIS L 1015.

(2) Single Filament Elongation

Measured according to JIS L 1015.

(3) Total Denier

This was calculated from the single filament denier and the number of thermoplastic, conjugate, continuous fibers that made up a fiber bundle or web.

(4) Number of Crimps

This was measured according to JIS L 1015 for drawn yarns that had been crimped, and the thermoplastic, conjugate, continuous fibers that made up the web.

(5) Fiber Bundle Density and Web Density

This was calculated from the width and thickness of the fiber bundle or web and the number of constituent thermoplastic, conjugate, continuous fibers.

The thickness of the fiber bundle or web was measured at a compression load of 0.5 gf/cm$^2$ using a Kato Tech YES-G5 Handy Compression Tester.

(6) Eccentricity

A fiber cross section was photographed with a microscope, and eccentricity was calculated from the following equation.

$$\text{eccentricity}(h)=d/r$$

r: radius of entire fiber d: distance from center point of entire fiber to center point of core component (7) Fiber Bundling 1 meter of a fiber bundle was examined for the location and condition of splitting in the fiber bundle. The evaluation criteria were to give a "good" rating if there was one or no location where the fiber bundle had split and completely separated, and "poor" if there were two or more.

(8) Pull-Up

A fiber bundle was put in a packaging container measuring 50×50×50 cm, and a load of 10 kg was applied for 5 minutes and then released. This fiber bundle was pulled up vertically at a rate of 15 meters per minute, and the fiber bundle was observed to check for knotting or tangling. A rating of "good"

was given if there was one or no problem during the 5 minutes, and "poor" if there were two or more.

(9) Fiber Bundle Spreading Test

A fiber bundle was drawn with a pinch roll type of spreading machine at a roll speed differential, and the drawing tension was released to open the fiber bundle and obtain a web. The line terminal velocity was 25 meters per minute.

(10) Extension Recovery Rate of Heat Treated Web and Member

A test piece whose width was 50 mm and length in the direction of fiber orientation was 150 mm was cut out. The test piece was fixed at one end using an Autograph AG-G tensile tester made by Shimadzu Seisakusho, with the chuck gap set at 100 mm. The test piece was drawn to 100% at a pulling rate of 100 mm/min, then returned at the same rate, until the load exerted on the test piece reached zero. Immediately after this, the test piece was again drawn to 100% at the same rate, and the extension recovery rate was calculated from the following equation, in which L mm is the length the test piece elongated when the load was commenced again.

$$\text{Extension recovery rate (\%) at 100\% stretch}=\{(100-L)/100\}\times 100$$

Working Example 1

Preparation of Fiber Bundle

Using high-density polyethylene as the sheath component, and polyethylene terephthalate as the core component, these were conjugated at a volumetric ratio of 50:50, and melt-spun from an eccentric sheath/core nozzle to obtain an undrawn yarn of 7.0 dtex. 25,000 of these undrawn yarns were bundled, and this bundle was drawn to a ratio of 2.0 with a hot roll drawing machine heated to 60° C., and then crimped at 15.2 crimps per 2.54 cm with a high-speed crimper with a width of 20 mm, after which this product was subjected to a drying heat treatment at 100° C., which gave a fiber bundle with a single filament denier of 3.5 dtex/f and a total denier of 86,940 dtex. This fiber bundle had good bundling properties and was easy to pull up, and the fiber bundle density was 960 dtex/mm$^2$. This fiber bundle was spread at 25° C. to a ratio of 1.6, a spiral crimp was manifested in the thermoplastic, conjugate, continuous fibers, which spread out uniformly in the width direction, and the spreading density ratio was 0.06.

Working Example 2

Preparation of Fiber Bundle

High-density polyethylene and polypropylene were conjugated at a volumetric ratio of 60:40, and melt-spun from a side-by-side nozzle to obtain an undrawn yarn of 14.7 dtex. 11,000 of these undrawn yarns were bundled, and this bundle was drawn to a ratio of 3.0 with a hot roll drawing machine heated to 90° C., and then crimped at 14.0 crimps per 2.54 cm with a high-speed crimper with a width of 20 mm, after which this product was subjected to a drying heat treatment at 100° C., which gave a fiber bundle with a single filament denier of 4.9 dtex and a total denier of 51,842 dtex. This fiber bundle had good bundling properties and was easy to pull up, and the fiber bundle density was 550 dtex/mm$^2$. This fiber bundle was spread at 25° C. to a ratio of 1.6, a spiral crimp was manifested in the thermoplastic, conjugate, continuous fibers, which spread out uniformly in the width direction, and the spreading density ratio was 0.09.

Working Example 3

Preparation of Fiber Bundle

Using polypropylene as the sheath component, and polyethylene terephthalate as the core component, these were conjugated at a volumetric ratio of 50:50, and melt-spun from an eccentric sheath/core nozzle to obtain an undrawn yarn of 15.6 dtex. 12,000 of these undrawn yarns were bundled, and this bundle was drawn to a ratio of 2.6 with a hot roll drawing machine heated to 120° C., and then crimped at 17.2 crimps per 2.54 cm with a stuffer box crimper with a width of 27 mm, after which this product was subjected to a drying heat treatment at 100° C., which gave a fiber bundle with a single filament denier of 6.0 dtex and a total denier of 74,520 dtex. This fiber bundle had good bundling properties and was easy to pull up, and the fiber bundle density was 710 dtex/mm$^2$. This fiber bundle was spread at 25° C. to a ratio of 1.6, a spiral crimp was manifested in the thermoplastic, conjugate, continuous fibers, which spread out uniformly in the width direction, and the spreading density ratio was 0.08.

Working Example 4

Preparation of Fiber Bundle

Using high-density polyethylene as the sheath component, and polyethylene terephthalate as the core component, these were conjugated at a volumetric ratio of 60:40, and melt-spun from an eccentric sheath/core nozzle to obtain an undrawn yarn of 57.2 dtex. 25,000 of these undrawn yarns were bundled, and this bundle was drawn to a ratio of 2.2 with a hot roll drawing machine heated to 60° C., and then crimped at 8.9 crimps per 2.54 cm with a high-speed crimper with a width of 20 mm, after which this product was subjected to a drying heat treatment at 100° C., which gave a fiber bundle with a single filament denier of 26 dtex and a total denier of 74,360 dtex. This fiber bundle had good bundling properties and was easy to pull up, and the fiber bundle density was 1180 dtex/mm$^2$. This fiber bundle was spread at 25° C. to a ratio of 1.6, a spiral crimp was manifested in the thermoplastic, conjugate, continuous fibers, which spread out uniformly in the width direction, and the spreading density ratio was 0.02.

Working Example 5

Preparation of Fiber Bundle

First, high-density polyethylene and polyethylene terephthalate were conjugated at a volumetric ratio of 50:50, and melt-spun from a side-by-side nozzle to obtain an undrawn yarn A of 6.9 dtex. Then, using high-density polyethylene as the sheath component, and polyethylene terephthalate as the core component, these were conjugated at a volumetric ratio of 55:45, and melt-spun from an eccentric sheath/core nozzle to obtain an undrawn yarn B of 33.6 dtex. 22,000 of these undrawn yarns A were bundled, and 2800 of the undrawn yarns B were bundled, the two bundles were laminated in the thickness direction, this product was drawn to a ratio of 2.1 with a hot roll drawing machine heated to 80° C., and then crimped with a high-speed crimper with a width of 20 mm, after which this product was subjected to a drying heat treatment at 100° C. The single filament denier of A was 3.3 dtex, and the number of crimps was 13.5 per 2.54 cm. The single filament denier of B was 16.0 dtex, and the number of crimps was 12.0 per 2.54 cm. The total denier of the fiber bundle was 115,590 dtex. This fiber bundle had good bundling properties and was easy to pull up, and the fiber bundle density was 1500 dtex/mm$^2$. This fiber bundle was spread at 25° C. to a ratio of 1.6, a spiral crimp was manifested in the thermoplastic, conjugate, continuous fibers, which spread out uniformly in the width direction, and the spreading density ratio was 0.05.

Comparative Example 1

An undrawn yarn was obtained in the same manner as in Working Example 1, except that a concentric sheath/core nozzle was used. This was drawn in the same manner as in Working Example 1, which gave a fiber bundle with a single filament denier of 3.5 dtex, a crimp number of 15.6 dtex, and a total denier of 87,500 dtex. This fiber bundle had good bundling properties and was easy to pull up, and the fiber bundle density was 990 dtex/mm$^2$. This fiber bundle was spread at 25° C. to a ratio of 1.6, whereupon it spread out in the width direction. However, whereas this spreading was accomplished by the manifestation of a spiral crimp in Working Example 1, here in Comparative Example 1 it appeared that it was accomplished by the elongation force of a zigzag crimp. Perhaps because of this, the resulting web was narrower and thinner than that in Working Example 1, and the density ratio by spreading was 0.13.

Comparative Example 2

High-density polyethylene and polypropylene were conjugated at a volumetric ratio of 40:60, and melt-spun from a side-by-side nozzle to obtain an undrawn yarn of 12.0 dtex. 25,000 of these undrawn yarns were bundled, and this bundle was drawn to a ratio of 3.0 with a hot roll drawing machine heated to 90° C., and then taken out without first going through a crimper. This gave a fiber bundle with a single filament denier of 4.0 dtex and a total denier of 99,360 dtex. Since the bundle had not gone through a crimper, it had substantially no crimp, but it did have an undulating curl with a large pitch. The bundling properties of this fiber bundle were extremely poor, and the width and thickness of the fiber bundle were inconsistent, so the fiber bundle density could not be measured. An attempt was made to pull this fiber bundle up from a packaging container, whereupon the fiber bundles frequently became knotted and tangled. The bundle was spread at 25° C. to a ratio of 1.6, whereupon a spiral crimp was manifested in the thermoplastic, conjugate, continuous fibers, which spread out in the width direction, but the width thereof was inconsistent, and there were portions where the fibers intersected in the width direction, so uniformity was poor.

Comparative Example 3

Using high-density polyethylene as the sheath component, and polyethylene terephthalate as the core component, these were conjugated at a volumetric ratio of 50:50, and melt-spun from an eccentric sheath/core nozzle to obtain an undrawn yarn of 14.0 dtex. 37,000 of these undrawn yarns were bundled, and this bundle was drawn to a ratio of 2.8 with a hot roll drawing machine heated to 60° C., and then crimped at 13.2 crimps per 2.54 cm with a high-speed crimper with a width of 20 mm, after which this product was subjected to a drying heat treatment at 100° C., which gave a fiber bundle with a single filament denier of 5.0 dtex and a total denier of 186,300 dtex. This fiber bundle had no problem with its bundling properties, and the fiber bundle density was high at 2060 dtex/mm$^2$, but the fiber bundle had a hard, compacted feel, and some of the thermoplastic, conjugate fibers stuck together. How well the fiber bundle could be pulled up was checked, and knotting and tangling occurred frequently, perhaps because of the sticking of the fibers. This fiber bundle was spread at 25° C. to a ratio of 1.6, and a spiral crimp was manifested in the thermoplastic, conjugate, continuous fibers, which spread out in the width direction, but the portions where the thermoplastic, conjugate, continuous fibers were stuck together were not spread, so the width was inconsistent uniformity was lacking.

Comparative Example 4

High-density polyethylene and polyethylene terephthalate were conjugated at a volumetric ratio of 50:50, and melt-spun from a side-by-side nozzle to obtain an undrawn yarn of 250 dtex. 37,000 of these undrawn yarns were bundled, and this bundle was drawn to a ratio of 2.1 with a hot roll drawing machine heated to 60° C., and then crimped at 7.8 crimps per 2.54 cm with a stuffer box crimper with a width of 27 mm, after which this product was subjected to a drying heat treatment at 100° C., which gave a fiber bundle with a single filament denier of 120 dtex and a total denier of 115,200 dtex. This fiber bundle had a bundle density of 1200, but the single filament denier of the thermoplastic, conjugate, continuous fibers was large, and the number of crimps was 7.8 per 2.54 cm, so bundling was poor and numerous splits in the fiber bundle were noted. How well the fiber bundle could be pulled up was checked, and knotting and tangling occurred frequently in the split portions of the fiber bundle. These split portions also caused poor spreading, so the spreading was inconsistent and the web lacked uniformity.

Comparative Example 5

According to the method described in Example 6 of JP KOKAI No. Hei 9-273037, using a random copolymer of propylene, ethylene, and butene-1 with a melting point of 135° C. as the sheath component, and using polypropylene as the core component, these were conjugated in a volumetric ratio of 50:50, and melt-spun from an eccentric sheath/core nozzle to obtain an undrawn yarn of 6.2 dtex.

25,000 of these undrawn yarns were bundled, and this bundle was drawn to a ratio of 2.8 with a hot roll drawing machine heated to 70° C., and then crimped at 18.0 crimps per 2.54 cm with a stuffer box crimper with a width of 27 mm, after which this product was subjected to a drying heat treatment at 60° C., which gave a fiber bundle with a single filament denier of 2.2 dtex and a total denier of 54,648 dtex. This fiber bundle had no problem with bundling properties and was easy to pull up, and the fiber bundle density was 510 dtex/mm$^2$. However, the thermoplastic, conjugate, continuous fibers stuck together very badly in some parts of the fiber bundle. This sticking seemed to have been produced by the pressure in the crimper, and the random copolymer of propylene, ethylene, and butene-1 was believed to be to blame because of its high friction and low melting point. The extent of this sticking was reduced when the method described in JP KOKAI No. Hei 9-273037 was employed to spray water on a tow (fiber bundle) right in front of the crimper. The fiber bundle obtained by thus reducing sticking was spread at 25° C. to a ratio of 1.6, whereupon a spiral crimp was manifested in some of the thermoplastic, conjugate, continuous fibers, but the density ratio by spreading was 0.14, and a uniform web of high bulk could not be obtained merely by an spreading process. Furthermore, when the portions where no spiral crimp was manifested were observed, the fiber bundles were stuck together, albeit weakly. This phenomenon also seems to be attributable to the random copolymer of propylene, ethylene, and butene-1 was believed to be to blame because of its high friction and low melting point.

Working Example 6

Preparation of Web and Manufacture of Wiper

The fiber bundle of Working Example 1 was spread at 25° C. to a ratio of 2.0, which gave a web with a single filament denier of 3.2 dtex and a total denier of 79,488 dtex. The density of this web was 17 dtex/mm$^2$, and the density ratio by spreading was 0.02. The thermoplastic, conjugate, continuous fibers that made up the web manifested a fine spiral crimp of 32 crimps per 2.54 cm, and had an extremely soft touch.

This web was laminated to a spunbond nonwoven cloth, and this was heat sealed at a spacing of 50 mm and a width of 5 mm in the width direction of the web. The surface area accounted for by the heat sealed portions was 9%. Next, the thermoplastic, conjugate, continuous fibers that made up the web were cut between the heat sealed portions, that is, in the middle portions of the 50 mm spacing, which gave the member shown in FIG. 1. A pile was then raised on this member to produce a wiper. This wiper had a softness, and was suited to dusting in tight spaces and uneven portions, such as the gaps in a keyboard, or a doll.

Figure 2:
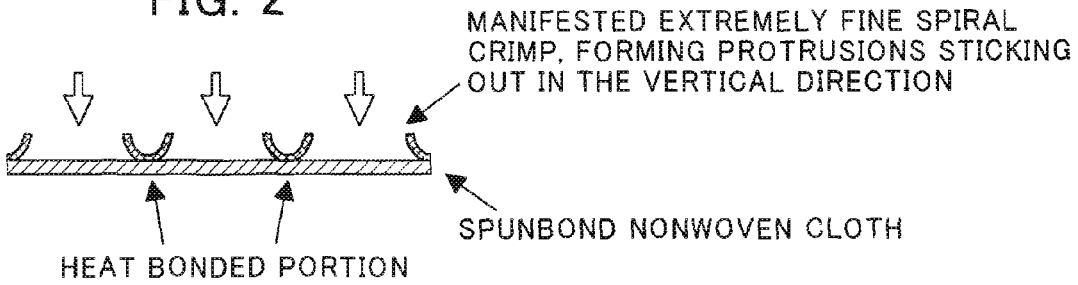
FIG. 2 schematically illustrates a cross section of a member obtained in Working Example 6, after heat treatment.

Also, the above-mentioned member obtained by cutting thermoplastic, conjugate, continuous fibers between heat sealed portions, that is, in the in the middle portions of the 50 mm spacing, was heat treated for 2 minutes in a 100° C. oven to develop spiral crimps in the thermoplastic, conjugate fibers and shrink the web, which gave the member shown in FIG. 2. Heat shrinkage increased the number of crimps to 120 per 2.54 cm, and the web density reached 35 dtex/mm$^2$. The web shrinkage was 56%, and protrusions were formed sticking out at an angle of 45 degrees with respect to the layer of the spunbond nonwoven cloth serving as the base. These protrusions were wiped back and forth over a floor (the wiping surface), whereupon friction with the floor caused the protrusions to stick out even more, so that the angle to the layer of the spunbond nonwoven cloth reached 70 degrees. This raising up of the protrusions allowed dirt to be trapped better, and a large quantity of sand and other such dirt with a large particle size was trapped.

Working Example 7

Preparation of Web and Production of Absorbent Material

The fiber bundle of Working Example 2 was spread at 30° C. to a ratio of 1.8, which gave a web with a single filament denier of 4.6 dtex and a total denier of 48,668 dtex. The web density was 26 dtex/mm$^2$, and the density ratio by spreading was 0.05. The thermoplastic, conjugate, continuous fibers that made up the web manifested a spiral crimp of 68 crimps per 2.54 cm, were extremely soft, and had high bulk. This web was laminated over a pulp absorbent material and a second sheet, and the ends were integrally heat sealed to produce an absorbent napkin. This absorbent material was extremely soft to the touch.

This web was heat treated for 1 minute in a 120° C. oven, whereupon the thermoplastic, conjugate, continuous fibers that made up the web manifested an extremely fine spiral crimp and shrank in the direction of fiber orientation. The thermoplastic, conjugate, continuous fibers constituting the web that had been shrunken by this heat treatment had a 170 crimps per 2.54 cm, and the web density was 80 dtex/mm$^2$. This web had good stretchability, and its extension recovery rate at 100% stretch was 85%. This stretchable web was then passed through an embossing roll with a proportional surface area of 8% to obtain a stretchable member. The extension recovery rate of this member at 100% stretch was 70%, it had good stretchability, and it could be used favorably as a substrate for a poultice.

Working Example 8

Preparation of Web and Production of Absorbent Material

The fiber bundle of Working Example 4 was spread at 50° C. to a ratio of 2.8, which gave a web with a single filament denier of 20.0 dtex and a total denier of 57,200 dtex. The web density was 10 dtex/mm$^2$, and the density ratio by spreading was 0.01. The thermoplastic, conjugate, continuous fibers that made up the web manifested a spiral crimp of 18 crimps per 2.54 cm, were extremely soft, and had high bulk. This web was laminated over a pulp absorbent material and a second sheet, and the ends were integrally heat sealed to produce an absorbent napkin. This absorbent material was extremely soft to the touch.

Working Example 9

Preparation of Web and Production of Sheet

Figure 3:
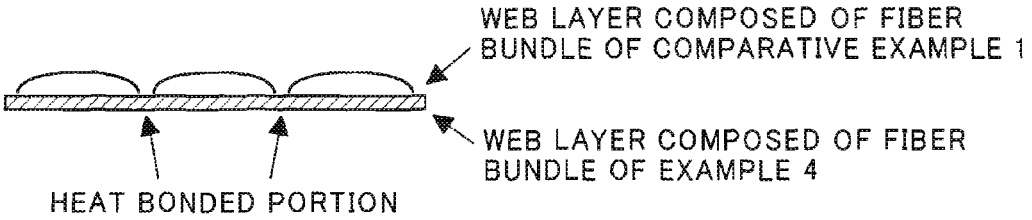
FIG. 3 schematically illustrates a cross section of a member obtained in Working Example 9, prior to heat treatment.
Figure 4:
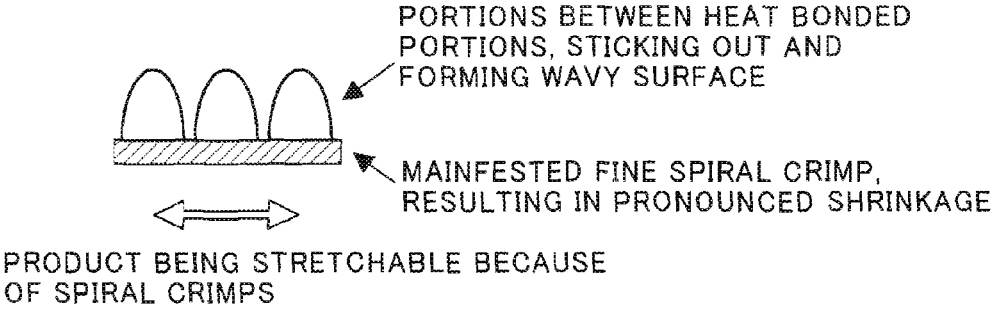
FIG. 4 schematically illustrates a cross section of a member obtained in Working Example 9, after heat treatment.

The fiber bundle of Working Example 4 was spread at 30° C. to a ratio of 2.8, which gave a web with a single filament denier of 20.3 dtex and a total denier of 58,058 dtex. The web density was 19 dtex/mm$^2$, and the density ratio by spreading was 0.02. The thermoplastic, conjugate, continuous fibers that made up the web manifested a spiral crimp of 36 crimps per 2.54 cm, were extremely soft, and had high bulk. This web was laminated with another web obtained by spreading the fiber bundle in Comparative Example 1 at 25° C. to a ratio of 1.6, and these webs were heat sealed at a spacing of 25 mm and a width of 5 mm in the width direction of the web, which gave the member shown in FIG. 3. This product was heat treated for 1 minute in a 100° C. oven, whereupon the thermoplastic, conjugate, continuous fibers that made up the web composed of the fiber bundle of Working Example 4 manifested an extremely fine spiral crimp, with pronounced heat shrinkage. This heat shrinkage produced 160 crimps per 2.54 cm in the thermoplastic, conjugate, continuous fibers of the layer composed of the fiber bundle of Working Example 4, and produced a web density of 43 dtex/mm$^2$. The heat seal spacing that had been 25 mm became 12 mm, the layer of the web composed of the fiber bundle of Comparative Example 1 stuck out to form a textured surface, and the stretchable member shown in FIG. 4 was obtained, whose stretchability originated in the extremely fine spiral crimps. This sheet could be used favorably as a floor wiper.

Working Example 10

Preparation of Web

The fiber bundle of Working Example 1 and the fiber bundle of Working Example 4 were laminated in their thickness direction and spread at 50° C. to a ratio of 2.0, which gave a web with a total denier of 141,106 dtex, in which thermoplastic, conjugate, continuous fibers with a single filament denier of 3.2 dtex and 26 crimps per 2.54 cm were laminated with thermoplastic, conjugate, continuous fibers with a single filament denier of 21.6 dtex and 20 crimps per 2.54 cm were laminated in the thickness direction. The web density was 19 dtex/mm$^2$. The web thus obtained consisted of two layers, but the boundary between these layers was indistinct, and the fibers of the two web layers were entangled, and therefore did not readily separate between the layers. This product was heat sealed at a spacing of 100 mm and a width of 5 mm in the width direction of the web. This web had a density gradient in its width direction, and there was a high degree of fiber freedom, which is beneficial when the product is used as an air filter.

Comparative Example 6

The web of Comparative Example 1 was spread at 25° C. to a ratio of 1.4, which gave a web with a single filament denier of 3.5 dtex and a total denier of 86,940 dtex. The web density was 170 dtex/mm$^2$, and the density ratio by spreading was 0.17. The thermoplastic, conjugate, continuous fibers that made up the web only had a zigzag crimp while in a fiber bundle state, and no spiral crimp was manifested. Compared to the web of Working Example 6, for example, there were more unspread portions and the bulkiness and softness were inferior.

Comparative Example 7

The web of Comparative Example 1 was spread at 25° C. to a ratio of 2.0, which gave a web with a single filament denier of 3.2 dtex and a total denier of 79,488 dtex. An attempt was made to improve spreading by raising the spreading ratio over that in Comparative Example 5, but the crimps in the thermoplastic, conjugate, continuous fibers were stretched completely out, so this actually had an adverse effect on spreading, and single filament breakage occurred frequently. As a result, the web density was high at 212 dtex/mm$^2$, and the softness was extremely poor.

Comparative Example 8

The fiber bundle of Comparative Example 3 was spread at 50° C. to a ratio of 2.0, which gave a web with a single filament denier of 4.3 dtex and a total denier of 160,218 dtex. However, there were portions of the fiber bundle that were stuck together, and said portions were not spread by drawing to the ratio of 2.0, so the uniformity of the web was lost and the web width was also inconsistent.

Tables 1 and 2 below show the properties of the fiber bundles and webs prepared in the working examples and comparative examples above.

The thermoplastic resin components 1 and 2 given in the tables are abbreviated as follows.

HDPE: high-density polyethylene

PET: polyethylene terephthalate

PP: polypropylene co-PP: random copolymer of propylene, ethylene, and butene-1

TABLE 1

Fiber bundle properties

| | W.E. 1 | W.E. 2 | W.E. 3 | W.E. 4 | W.E. 5 | | C.E. 1 | C.E. 2 | C.E. 3 | C.E. 4 | C.E. 5 |
|---|---|---|---|---|---|---|---|---|---|---|---|
| Component 1 | HDPE | HDPE | PP | HDPE | HDPE | HDPE | HDPE | HDPE | HDPE | HDPE | cc-PP |
| Component 2 | PET | PP | PET | PET | PET | PET | PET | PP | PET | PET | PP |
| Cross sectional shape | ecc. SC | side-by-side | ecc. SC | ecc. SC | side-by-side | ecc. SC | conc. SC | ecc. SC | ecc. SC | side-by-side | ecc. SC |
| Single filament denier (dtex) | 3.5 | 4.9 | 6.0 | 26.0 | 3.3 | 16.0 | 3.5 | 4.0 | 5.0 | 120 | 2.2 |
| Total denier (dtex) | 86,900 | 51,800 | 74,500 | 74,400 | 69,800 | 45,800 | 87,500 | 99,400 | 186,000 | 115,000 | 55,000 |
| Fiber bundle density (dtex/mm$^2$) | 960 | 550 | 710 | 1180 | 1050 | | 990 | — | 2060 | 1200 | 510 |
| Number of crimps (per 2.54 cm) | 15.2 | 14.0 | 17.2 | 8.9 | 13.5 | 12.0 | 15.6 | 0 | 13.2 | 7.8 | 18.0 |
| Elongation (%) | 88 | 138 | 120 | 93 | 90 | 110 | 65 | 82 | 61 | 164 | 66 |
| Eccentricity | 0.4 | — | 0.5 | 0.5 | — | 0.5 | 0 | 0.2 | 0.4 | — | 0.4 |
| Bundling | good | good | good | good | good | | good | poor | good | poor | good |
| Pull-up | good | good | good | good | good | | good | poor | poor | poor | good |
| Density ratio by spreading | 0.06 | 0.09 | 0.08 | 0.02 | 0.05 | | 0.13 | — | — | — | 0.14 |
| Uniformity | excellent | excellent | excellent | excellent | excellent | | excellent | poor | poor | poor | fair |

W.E.: Working Example

C.E.: Comparative Example ecc. SC: eccentric sheath-core conc. SC: concentric sheath-core

TABLE 2

Web properties

| | W.E. 6 | W.E. 7 | W.E. 8 | W.E. 9 | W.E. 10 | | C.E. 6 | C.E. 7 | C.E. 8 |
|---|---|---|---|---|---|---|---|---|---|
| Component 1 | HDPE | HDPE | HDPE | HDPE | HDPE | HDPE | HDPE | HDPE | HDPE |
| Component 2 | PET | PP | PET | PET | PET | PET | PET | PET | PET |
| Cross sectional shape | ecc. SC | side-by-side | ecc. SC | ecc. SC | ecc. SC | ecc. SC | conc. SC | conc. SC | ecc. SC |

TABLE 2-continued

| Web properties | | | | | | | | |
|---|---|---|---|---|---|---|---|---|
| | W.E. 6 | W.E. 7 | W.E. 8 | W.E. 9 | W.E. 10 | C.E. 6 | C.E. 7 | C.E. 8 |
| Ratio (times) | 2.0 | 1.8 | 2.8 | 2.8 | 2.0 | 1.4 | 2.0 | 2.0 |
| Temperature (° C.) | 25 | 30 | 50 | 30 | 50 | 25 | 25 | 50 |
| Single filament denier (dtex) | 3.2 | 4.6 | 20.0 | 20.3 | 3.2 21.6 | 3.5 | 3.2 | 4.3 |
| Total denier (dtex) | 79,500 | 48,700 | 57,200 | 58,100 | 141,000 | 86,900 | 79,500 | 160,000 |
| Web density (dtex/mm$^2$) | 17 | 26 | 10 | 19 | 19 | 193 | 212 | — |
| Number of crimps (per 2.54 cm) | 32 | 68 | 18 | 36 | 24 20 | 12.0 | — | 40 |

The invention claimed is:

1. A fiber bundle, wherein the fiber bundle has total denier of 10,000 to 500,000 dtex, and the fiber bundle is a bundle of thermoplastic, conjugate, continuous fibers, each of which is made of same conjugate components as the conjugate components in other fibers in the bundle of the thermoplastic, conjugate, continuous fibers, wherein the thermoplastic, conjugate, continuous fibers have single filament denier of 0.5 to 100 dtex/f, in thermoplastic, conjugate, and continuous fibers, a center of gravity of the conjugate components of the fibers in a fiber cross section varies among the conjugate components, the thermoplastic, conjugate, continuous fibers that form the fiber bundle have an apparently existent crimp of 8 to 30 crimps per 2.54 cm, the apparently existent crimp is in a shape of a serrated zigzag crimp or an Ω-shaped crimp, thermoplastic resin that forms a surface of the thermoplastic, conjugate, and continuous fiber is polyethylene-based thermoplastic resin or polypropylene-based thermoplastic resin, wherein polypropylene-based thermoplastic resin that is a binary copolymer, a tertiary copolymer, or a quaternary copolymer of propylene as a primary monomer with one or more α-olefins other than propylene is excluded, a fiber bundle density as defined by D1/(W1×L1) (where D1 is total denier, W1 is a fiber bundle width, and L1 is a fiber bundle thickness) is 100 to 2000 dtex/mm$^2$, and a density ratio by spreading (which is a web density/fiber bundle density after spreading by drawing to a ratio of 1.6 in a pinch roller spreading machine at a rate of 25 m/min where a fiber bundle temperature is 25° C.) is 0.10 or less.

2. The fiber bundle according to claim 1, wherein elongation of the thermoplastic, conjugate, continuous fibers is at least 70%.

3. The fiber bundle according to claim 1, wherein a cross section of the individual thermoplastic, conjugate, continuous fiber is an eccentric sheath-core structure.

4. The fiber bundle according to claim 3, wherein the eccentricity of the core component of the thermoplastic, conjugate, continuous fibers is at least 0.2.

* * * * *